United States Patent [19]

Cederqvist et al.

[11] 4,193,841

[45] Mar. 18, 1980

[54] METHOD FOR THE MANUFACTURE OF A MINERAL FIBER SHEET

[75] Inventors: Gunnar Cederqvist, Lerdala; Ulf Åberg, Skövde, both of Sweden

[73] Assignee: Rockwool Aktiebolaget, Skövde, Sweden

[21] Appl. No.: 804,287

[22] Filed: Jun. 7, 1977

[51] Int. Cl.[2] ..... D21H 5/18

[52] U.S. Cl. ..... 162/152; 162/168 R; 162/169; 162/183; 162/184; 162/185; 162/192; 162/206

[58] Field of Search ..... 162/145, 152, 184–186, 162/169, 183, 155, 156, 192, 206, 168 R; 427/27, 32, 391, 421

[56] References Cited

U.S. PATENT DOCUMENTS

| | | | |
|---|---|---|---|
| 2,899,353 | 8/1959 | Engel et al. | 162/169 |
| 3,042,577 | 7/1962 | Thomas | 162/186 |
| 3,243,340 | 3/1966 | Cadotte | 162/155 |
| 3,376,189 | 4/1968 | Nystrom | 162/206 |
| 3,536,580 | 10/1970 | Fave | 162/186 |
| 3,766,002 | 10/1973 | Grief et al. | 162/169 |
| 3,776,812 | 12/1973 | Jongetjes | 162/169 |

FOREIGN PATENT DOCUMENTS

| | | | |
|---|---|---|---|
| 850044 | 8/1970 | Canada | 162/186 |
| 707946 | 4/1954 | United Kingdom | 162/155 |
| 1338759 | 11/1973 | United Kingdom | 162/169 |

OTHER PUBLICATIONS

Calkin, "Mod. Pulp & Papermaking," (1957), pp. 312, 313.

*Primary Examiner*—S. Leon Bashore
*Assistant Examiner*—Peter Chin
*Attorney, Agent, or Firm*—Larson, Taylor and Hinds

[57] ABSTRACT

A method for the manufacture of a sheet containing mineral fibers and binder. An aqueous suspension containing fibers and binder is formed into a layer. The layer is de-watered to form a wet sheet. Additional binder is applied evenly to the entire surface of the de-watered sheet. The sheet is then dried. The sheet may be compressed to an extent of 20% during drying.

10 Claims, No Drawings

METHOD FOR THE MANUFACTURE OF A MINERAL FIBER SHEET

In manufacturing certain types of floor material, a sheet, having as its substantial constituent asbestos, is used as support felt. Asbestos, however, may mean risks for health, and it has therefore been proposed, in this connection as well as in other connection that the asbestos should be exchanged against artificial mineral wool, for instance stone wool, glass wool or the like, because artificial mineral wool will not cause the health risks, which are given by the asbestos. Replacing now, however, asbestos simply with the corresponding amount of mineral wool, one will get a fibrous path, the rigidity against pulling, the flexibility and the impression resistance are much inferior in relation to the product, based upon asbestos as fibrous material. The artificial mineral fibres, contrary to the asbestos fibres, are quite smooth and require quite a different binding effect than the asbestos. Even binding means amounts, which are obviously unechonomical, and also unsuitable from other points of view, have proved not to be capable of overbridging this difference in fibrous properties.

By the present invention, however, a method is given, through which a fibrous path, based on artificial mineral wool, will be given such properties with reasonable amounts of binding means that it may replace the corresponding asbestos products. The method according to the present invention however, has a wider use than only to replace asbestos products. The invention refers to a wet process, where a suspension of artificial mineral fibres in water is first prepared, a sheet is formed from the fibrous suspension, and finally this sheet is dried.

According to the invention, the binding means is added in two steps, so that one part is added to the fibrous suspension before the formation into sheet and the de-watering, and a second part is added to the formed, wet sheet, preferably so late that de-watering has been finished at least approximately completely.

It has proved suitable, during the first binding means step, the prefixation, to use as binding means a latex from an acrylate polymerous product. The best binding effect in the pre-fixation is achieved, if the latter dispersion is allowed to coagulate before the formation of sheets takes place. The coagulation may take place either before or after the dispersion being added to the fibrous suspension. However, it is preferable that the latex dispersion is coagulated before it is added to the fibre suspension, as it is thereby more easy to supervise the procedure. The coagulation is carried through in any way, known per se, by change of the pH-value, for instance by adding an alum solution.

For the addition of binding means, which takes place after the sheet have been formed, and after the de-watering having been finished at least approximately completely, a styrenous butadiene latex or a similar binding means is most suitable. It is decisive to a high degree for the binding means effect that this second addition of binding means is distributed as well as possible. Obviously, it is important that as many contact points are fixed between the fibres as possible. On the other side, for each such fixation only a minimum amount of binding means is required. It has proved that spraying, in which a very far reaching fine distribution is achieved, forms the best way of addition in this step of the procedure. The cloud of binding means drops emanating from the spray device however, at a high degree of distribution is difficult to steer to the desired eveness over all of the width of the sheet, and therefore it has proved that one has for the best results to rely upon electrostatic spraying.

Dependent upon the range of use and the desired properties, the need of binding means in the two steps may vary rather much. In neither one of said steps, however, less than 2% of the weight of the mass of fibres should be used, nor should more than 25% be used. A satisfactory bond as a rule is achieved if the total amount of binding means is between 10 and 40%, and usually one may with advantage limit this amount to the interval of 20–30%. Optimum of economy of material with respect to the rigidity is obtained if there is added during the first addition about 15% of binding means to be calculated on the weight of the fibrous mass, whereas the second step is limited to about 10%.

A very remarkable improvement of the binding means effect is achieved if the drying takes place during compression of the fibrous path. The reason thereof is assumed to be that the binding means drops, especially those ones which have been added during the second binding means addition step, are shrinking at the drying so that they will loose their contact with one of the fibres, which they should otherwise bind together. A remedy against this then has proved to be, by compression to decrease the resistance between the fibres and thereby to press the fibres into the drops in such a way that both of the fibres get in contact with the binding means particle or particles, resp., in the dispersion drop. After drying and de-loading, the fibrous path will expand a little, but at this time the binding is already established. In order that the effect shall be measurable, a given compression is required of at least 20% and preferably also at least 40%

Further, it has proved that a compression at the end of the drying procedure will not give the same effect as if the compression is allowed to remain during the major part of the drying procedure. The reason of this matter of fact has not yet been completely clarified.

A suitable means for providing this compression retained during the drying procedure has been found to be the use of drying systems of one cylinder type, where the pressing pressure is provided by stretching the drying felt or the vira, which more or less completely surrounds the drying cylinder. Also multiple cylinder machines may be used as it has proved not to be of too great an importance to deload the compression pressure when turning over from one cylinder to another one. However, it is required that the compression is kept rather unitary between the different drying cylinders.

Below some examples on the characteristics of this invention will be given along with measuring results showing the essential effect caused by said characteristics. However, it is understood that the invention may as well be used in other ways within the frame of the claims.

EXAMPLE

A fibrous suspension, the participation of stone woll fibres is 0.1% is prepared. To this suspension a latex dispersion of an acrylate polymeric product, which has been coagulated in advance is added in varying amount. From the binding means containing fibrous suspension on a vira of the type "Voith Hydroformer" a sheet is manufactured, which is de-watered by means of vacuum to about 40% dry substance contents. After the de-watering the sheet is sprayed with a styrene butadiene latex. The drying is executed during simultaneous compression on a drying cylinder about which a vira is stretched, and the pulling force is adjustable. After the sheet has passed the drying cylinder, practically all water has been removed.

The following combinations have been tested:

| Test | A | B | C | D | E | F |
|---|---|---|---|---|---|---|
| Binding means in fibrous suspension | 0 | 0 | 30% acrylate | 15% acrylate | 15% acrylate | 30% acrylate |
| Deposited binding means | No | No | Yes | Yes | Yes | Yes |
| Binding means after forming the sheet | 0 | 25% styrene butadiene latex | 0 | 10% styrene butadiene latex | 10% styrene butadiene latex | 0 |
| Pulling force in the vira | 0,4 kp/cm | 0,4 kp/cm | 0,4 kp/cm | 0,4 kp/cm | 20 kp/cm | 20 kp/cm |
| Compression during drying | 10% | 10% | 10% | 10% | 60% | 60% |
| Pulling rigidity | | | | | | |
| lengthway | 2,7 N/3cm | 9,2 N/3cm | 8,7 N/3cm | 20,5 N/3cm | 60 N/3cm | 34 N/3cm |
| crossway | 2,6 N/3cm | 8,7 N/3cm | 8,9 N/3cm | 17,3 N/3cm | 53 N/3cm | 27 N/3cm |
| Impression rigidity[1)] | | | | | | |
| during load | | 1,93 mm | 1,87 mm | 1,40 mm | 0,50 mm | 0,71 mm |
| after deloading | | 1,90 mm | 1,81 mm | 1,35 mm | 0,38 mm | 0,64 mm |

[1)]a steel ball of 20 mm 0 loads the path during 5 minutes and the impression is measured. After deloading during 5 minutes the pressure is again measured.

An addition of binding means in two steps and compression during the drying procedure as seen from the below table, clearly shows the best values on pulling rigidity as well as impression rigidity.

We claim:

1. A method for the manufacture of an asbestos-free sheet containing mineral fiber and binder, said sheet being of the type useful as a support felt in flooring, the method comprising the steps of providing an asbestos-free aqueous suspension containing mineral wool fibers and a first portion of binder, forming an asbestos-free layer comprising said aqueous suspension, de-watering said layer to provide an asbestos-free wet sheet containing mineral wool fiber and said first portion of binder, applying a second portion of binder evenly to the entire area of said wet sheet, and thereafter drying the wet sheet to provide a dried, asbestos-free, sheet containing mineral wool fiber and binder, said first portion of binder comprising a dispersion of a resin latex in a liquid medium in which the dispersion is coagulated before it is incorporated into said aqueous suspension, the total amount of said first and second binder portions being from 10 to 40% by weight of said fibers.

2. A method according to claim 1 wherein said first portion of binder comprises acrylic resin latex.

3. A method according to claim 2 wherein said second portion of binder comprises a styrene butadiene latex.

4. A method according to claim 3 wherein said second binder portion is applied to said wet sheet by spraying said second binder portion thereon.

5. A method according to claim 4 wherein said spraying is effected by electrostatic spraying.

6. A method according to claim 2 wherein said first binder is present in an amount of from 2 to 25% by weight of said fibers.

7. A method according to claim 6 wherein said second binder portion is present in an amount of from 2 to 25% by weight of said fibers.

8. A method according to claim 3 wherein the total amount of said first and second binder portions is from 20 to 30% by weight of said fibers.

9. A method according to claim 3 wherein the wet sheet is compressed at least 20% while the wet sheet is being dried.

10. A method according to claim 3 wherein the wet sheet is compressed at least 40% while the wet sheet is being dried.

* * * * *